US006831633B1

(12) United States Patent
Murade

(10) Patent No.: US 6,831,633 B1
(45) Date of Patent: Dec. 14, 2004

(54) ELECTRO-OPTICAL DEVICE, METHOD FOR DRIVING THE SAME, SCANNING LINE DRIVING CIRCUIT, AND ELECTRONIC EQUIPMENT

(75) Inventor: Masao Murade, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 173 days.

(21) Appl. No.: 09/625,194

(22) Filed: Jul. 21, 2000

(30) Foreign Application Priority Data

Jul. 23, 1999 (JP) ..... 11-209305
Jun. 14, 2000 (JP) ..... 2000-178346

(51) Int. Cl.[7] ..... G09G 5/00

(52) U.S. Cl. ..... 345/204; 345/50; 345/55; 348/458; 348/751

(58) Field of Search ..... 345/204, 50, 55, 345/84, 87, 92, 100, 99; 348/101, 458, 751, 760–761, 581, 384

(56) References Cited

U.S. PATENT DOCUMENTS 5,025,315 A * 6/1991 Johary et al. ..... 348/441
5,142,363 A * 8/1992 Johary et al. ..... 348/581
5,262,864 A * 11/1993 Saeger et al. ..... 348/561
5,294,987 A * 3/1994 Saeger et al. ..... 348/536
5,680,151 A * 10/1997 Grimm et al. ..... 345/419
5,786,863 A * 7/1998 Collins ..... 348/458
5,790,096 A * 8/1998 Hill, Jr. ..... 345/600
5,796,442 A * 8/1998 Gove et al. ..... 348/556
5,914,753 A * 6/1999 Donovan ..... 348/441
5,929,924 A * 7/1999 Chen ..... 348/458
6,014,125 A * 1/2000 Herbert ..... 345/213
6,133,956 A * 10/2000 Ludgate et al. ..... 348/441
6,281,873 B1 * 8/2001 Oakley ..... 345/418
6,327,000 B1 * 12/2001 Auld et al. ..... 348/441
6,380,974 B1 * 4/2002 Hieda et al. ..... 348/234
6,392,701 B1 * 5/2002 Akeyama et al. ..... 345/667
6,404,459 B1 * 6/2002 Kitou et al. ..... 345/698
6,441,858 B1 * 8/2002 Nakamoto et al. ..... 348/446
6,456,432 B1 * 9/2002 Lazzaro et al. ..... 359/464

FOREIGN PATENT DOCUMENTS

JP A-59-23986 2/1984
JP A-8-8674 1/1996
JP A-8-166766 6/1996
JP A-9-51496 2/1997
JP 9051496 * 2/1997
JP A-9-270977 10/1997
JP A-11-18027 1/1999
JP 11153980 * 6/1999
JP A-11-153980 6/1999
JP A-2000-13813 1/2000

OTHER PUBLICATIONS

Translation of JP 9051496.*

* cited by examiner

*Primary Examiner*—Vijay Shankar
*Assistant Examiner*—Leonid Shapiro
(74) *Attorney, Agent, or Firm*—Oliff & Berridge, PLC

(57) ABSTRACT

In an electro-optical device including a scanning line driving circuit, the scanning line driving circuit includes a transfer direction control circuit for controlling the direction of transfer of a start pulse, a shift register for shifting the start pulse, supplied by the transfer direction control circuit, in response to a clock signal, and an output selection circuit for selecting the output signal of the shift register in accordance with a first enable signal and a second enable signal. A decimation process and a stretching process are performed by controlling the first enable signal and the second enable signal in accordance with the video line count of an input video signal.

22 Claims, 13 Drawing Sheets

[FIG. 1]
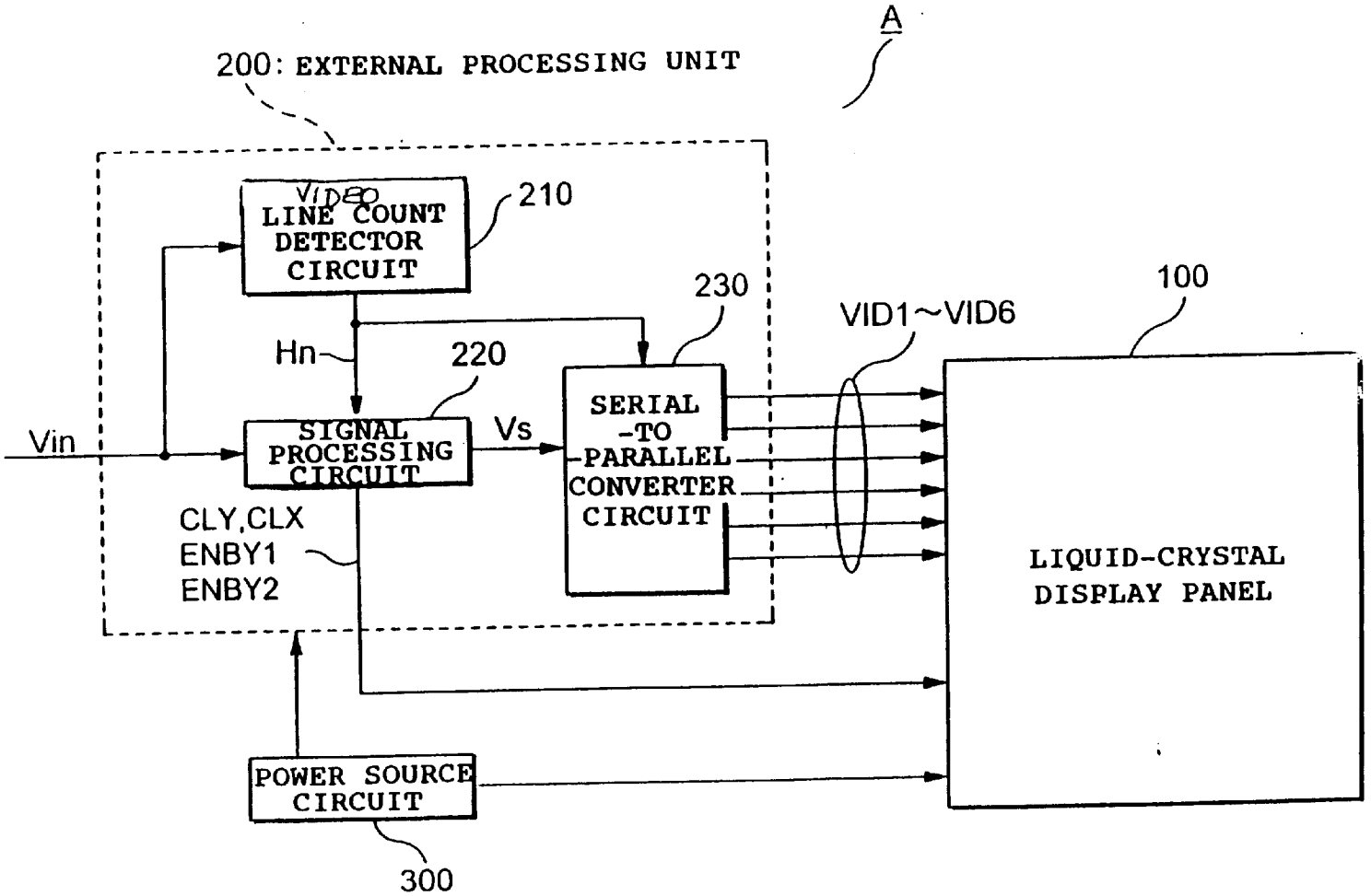

[FIG. 2]
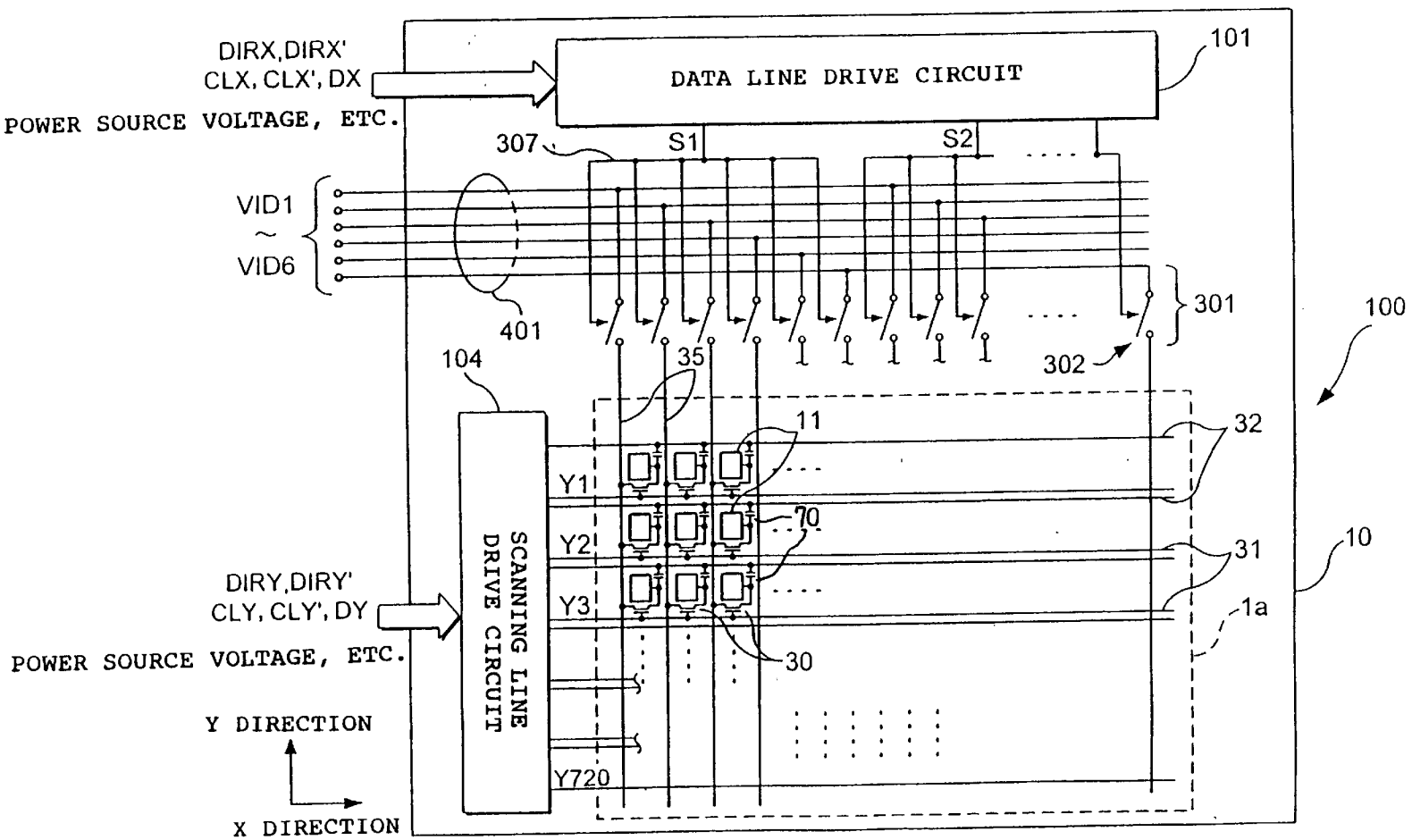

[FIG. 3]
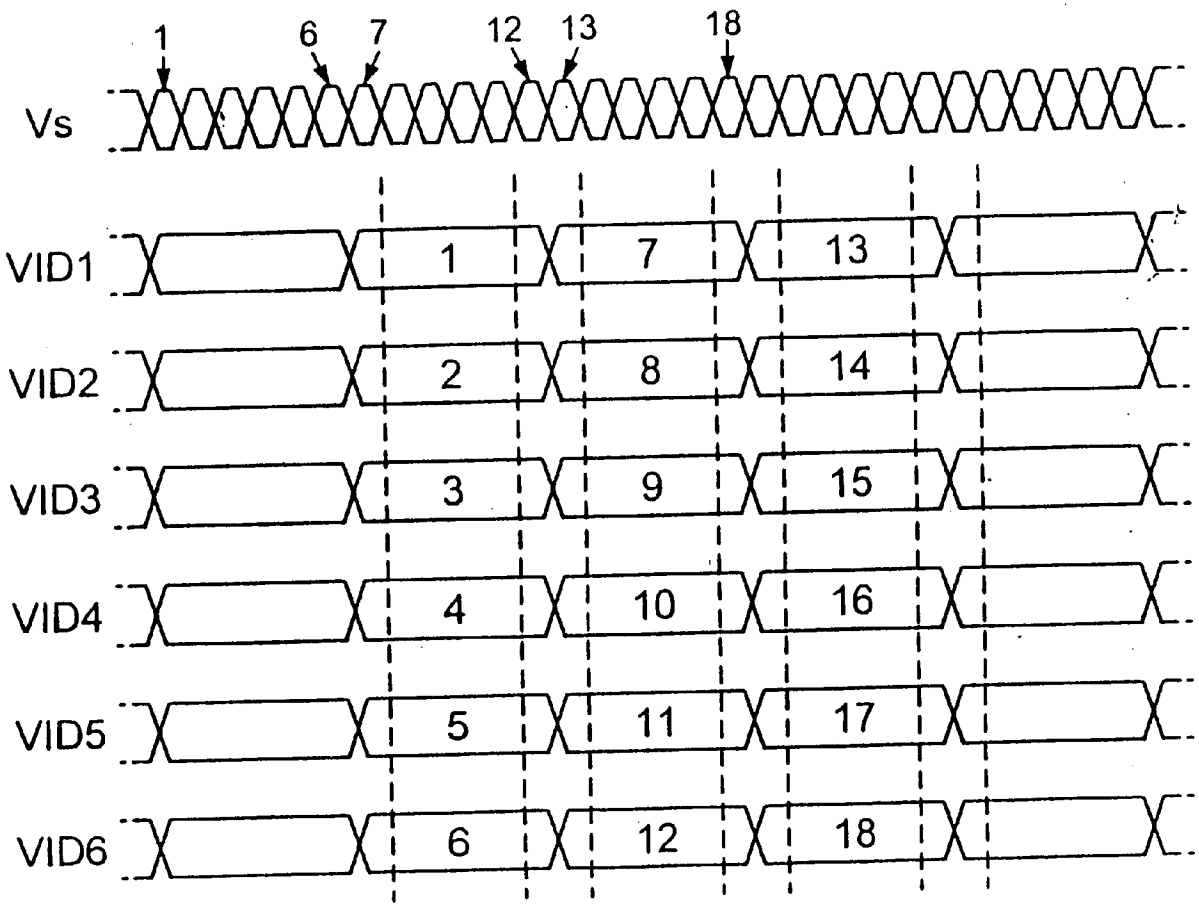

[FIG. 4]
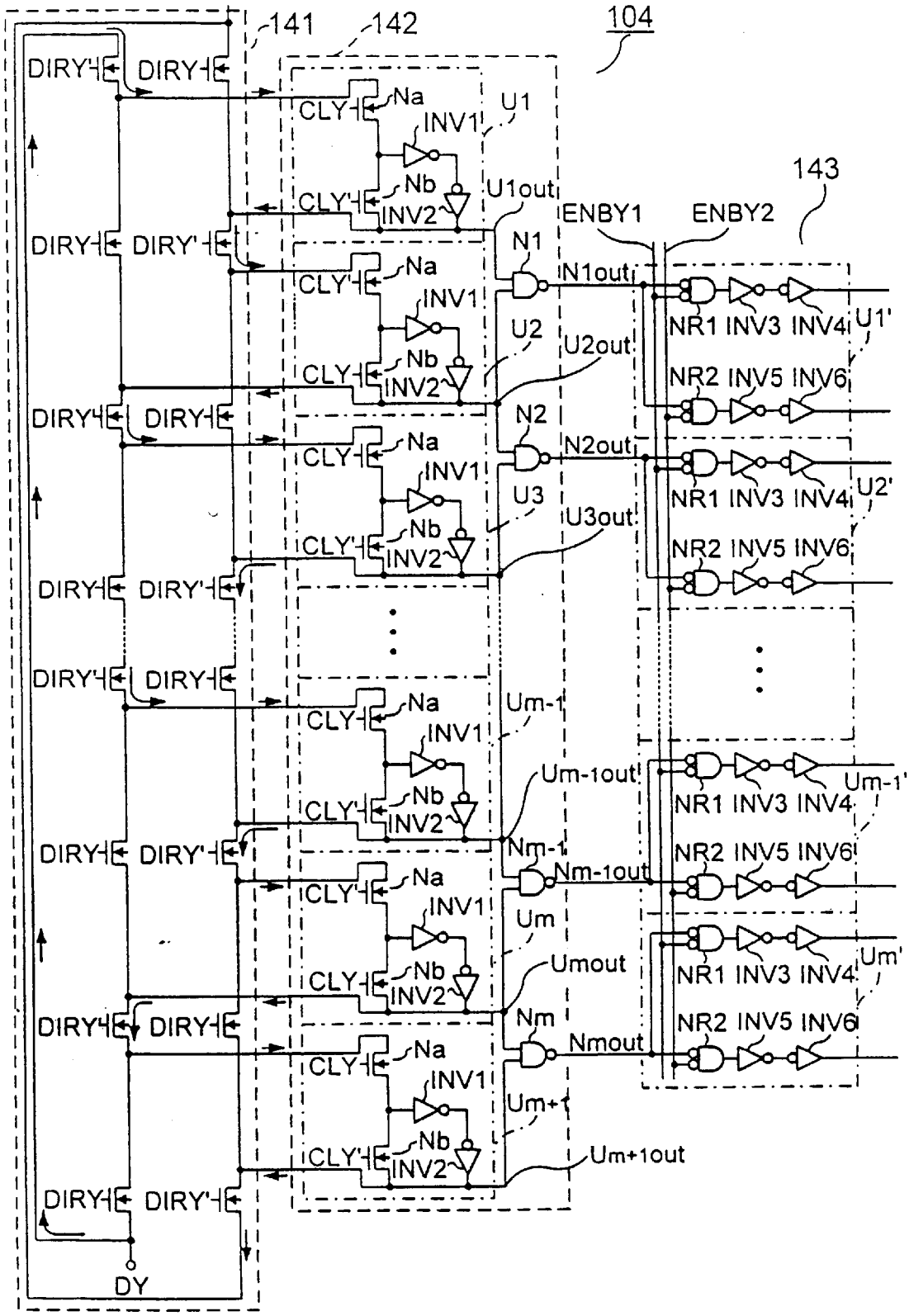

[FIG. 5]
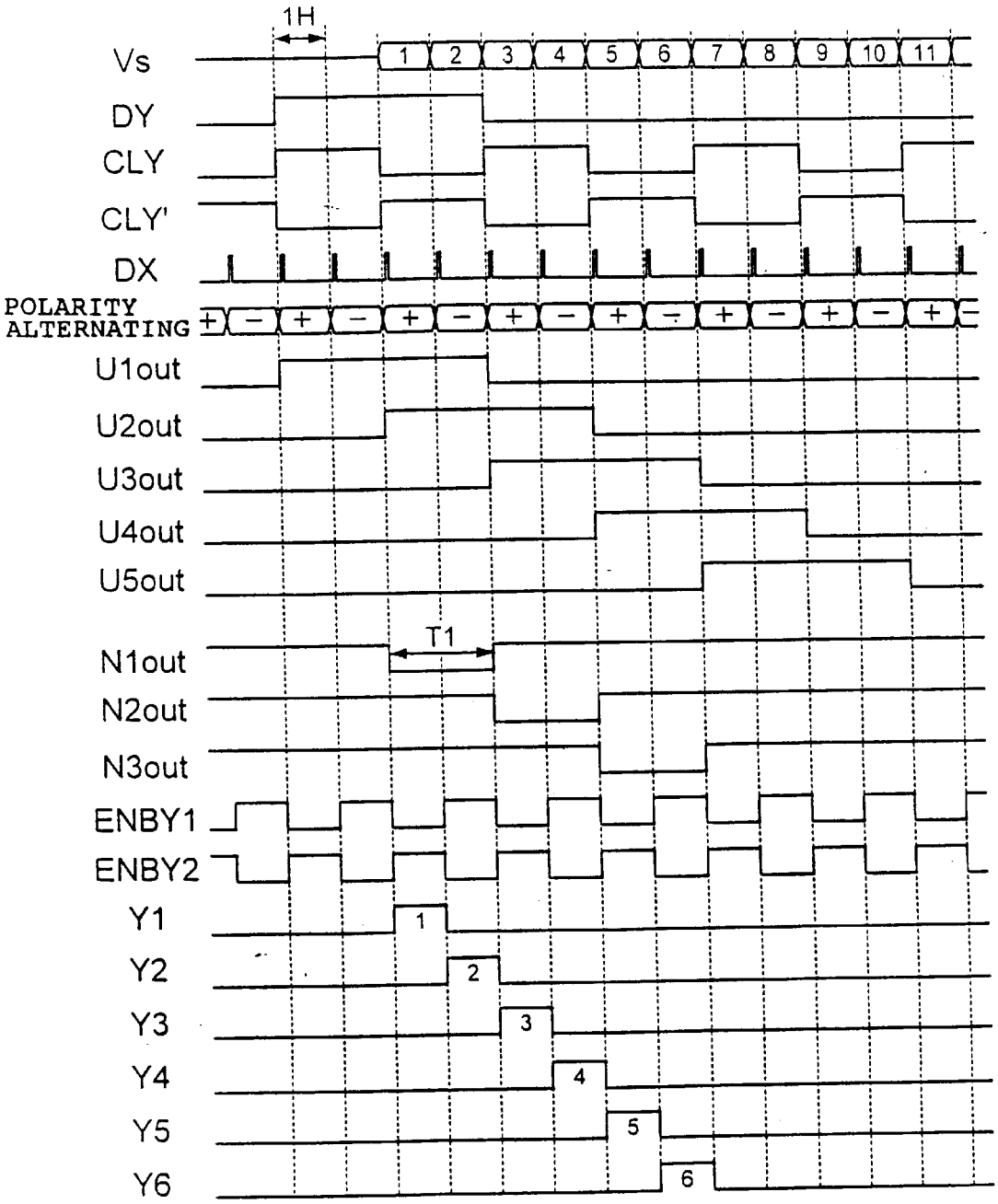

[FIG. 6]
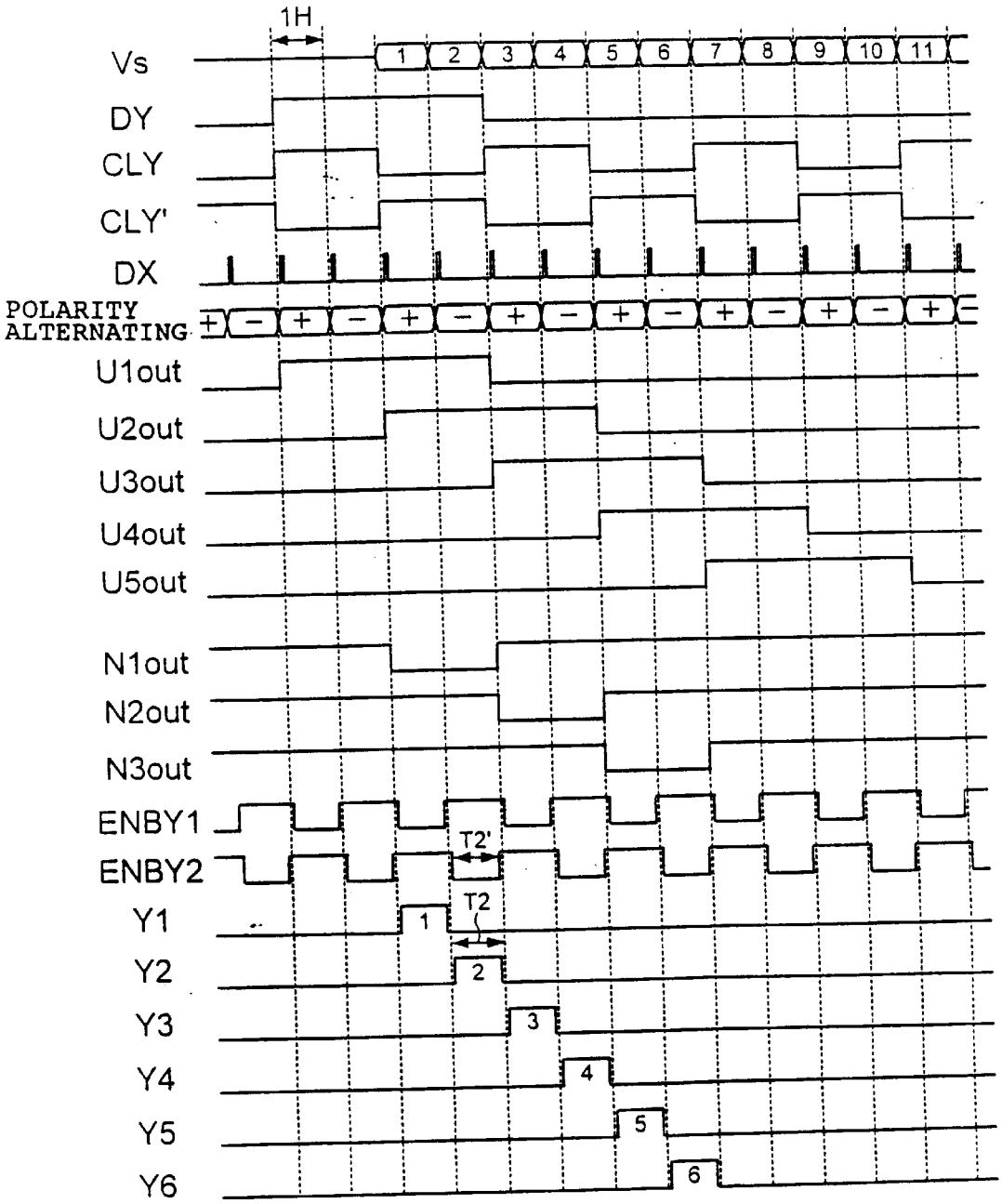

[FIG. 7]
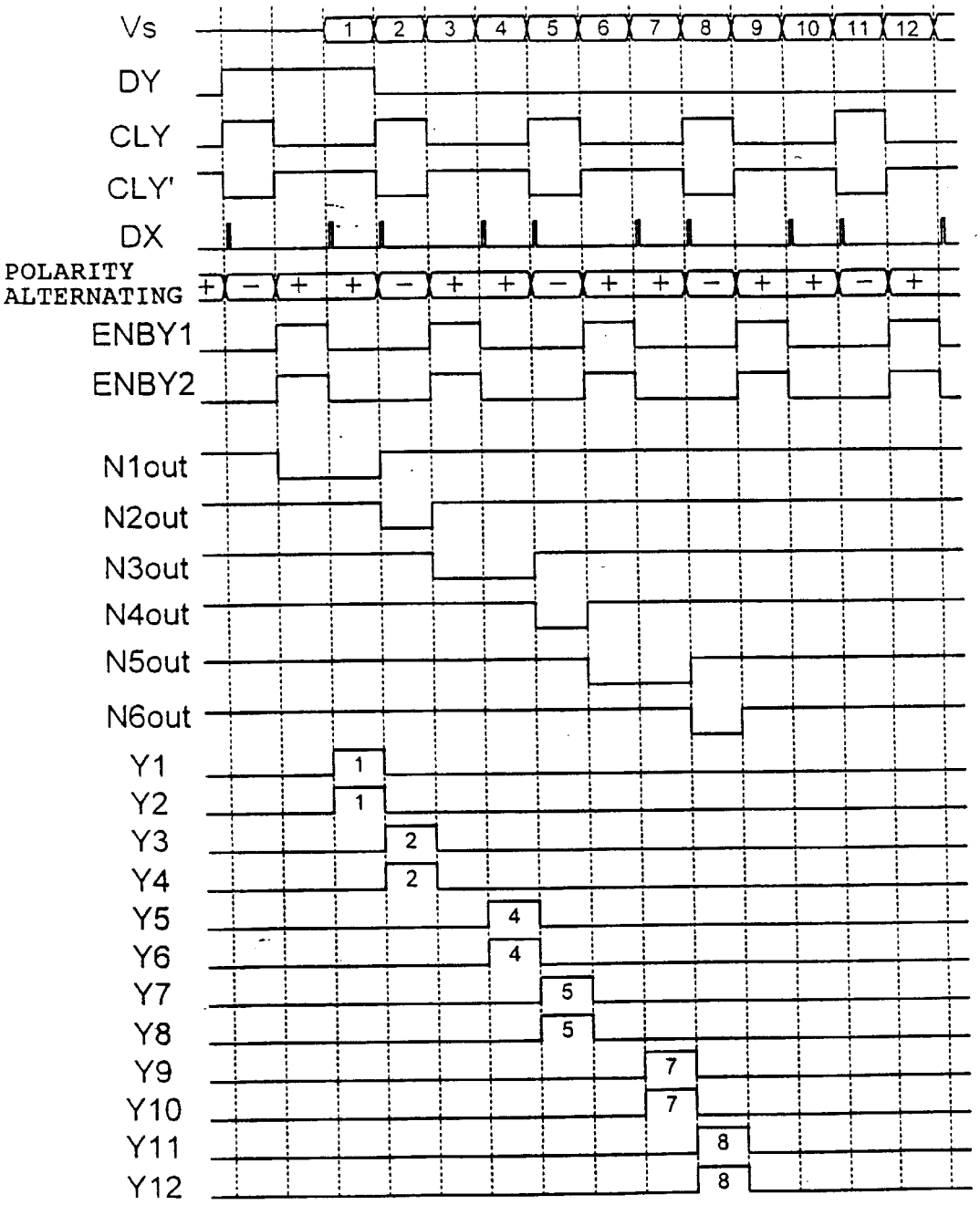

[FIG. 8]
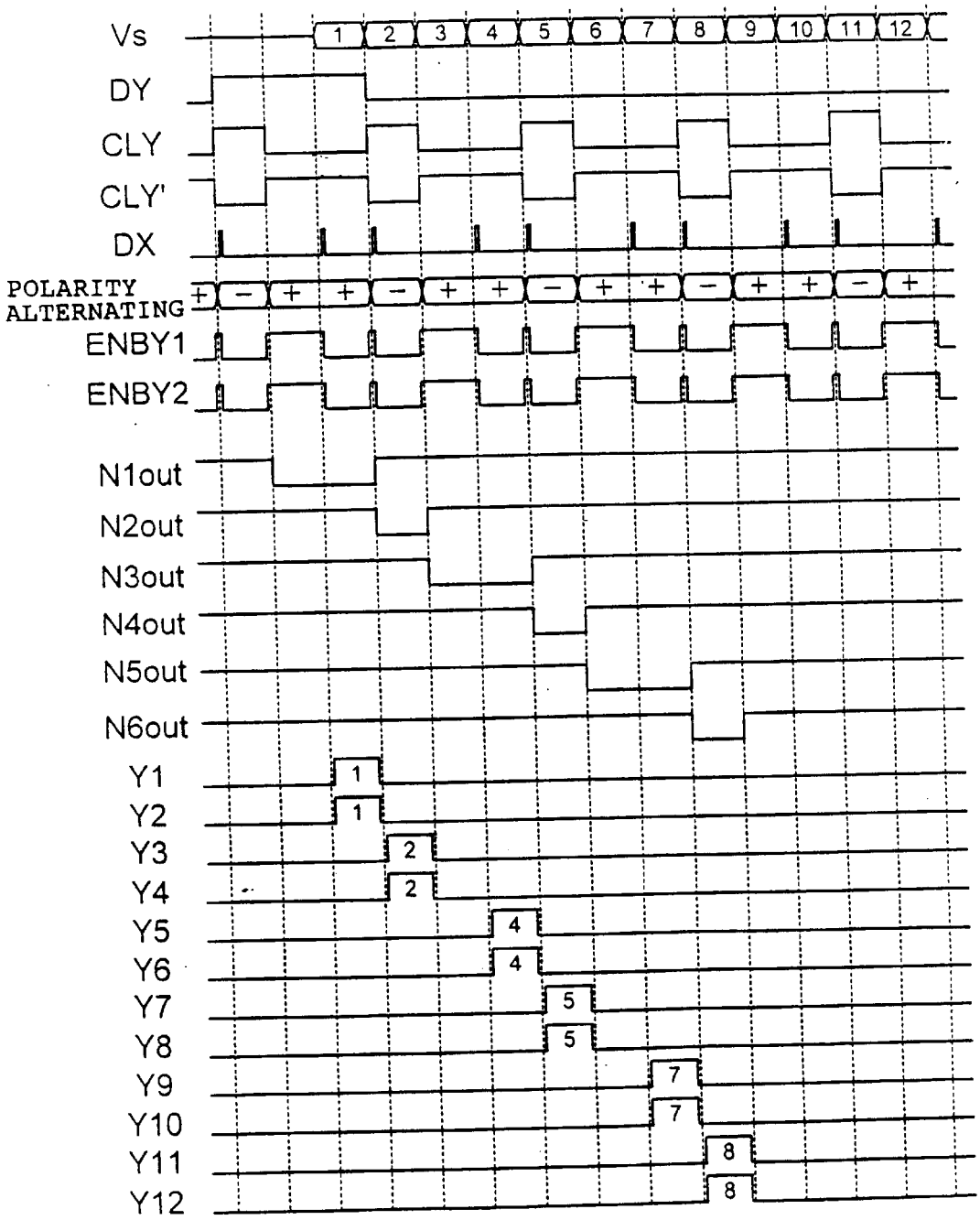

[FIG. 9]
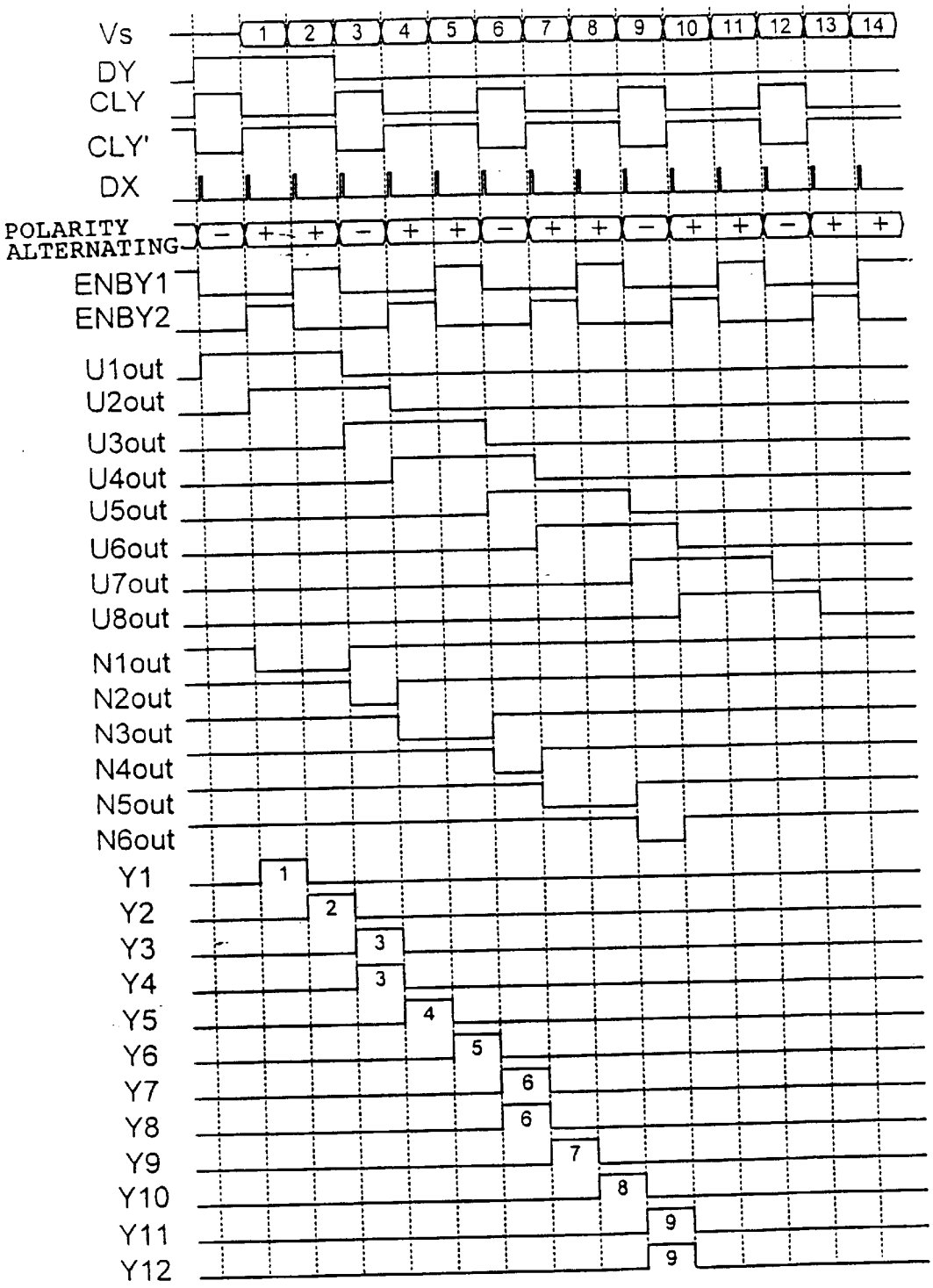

[FIG. 10]
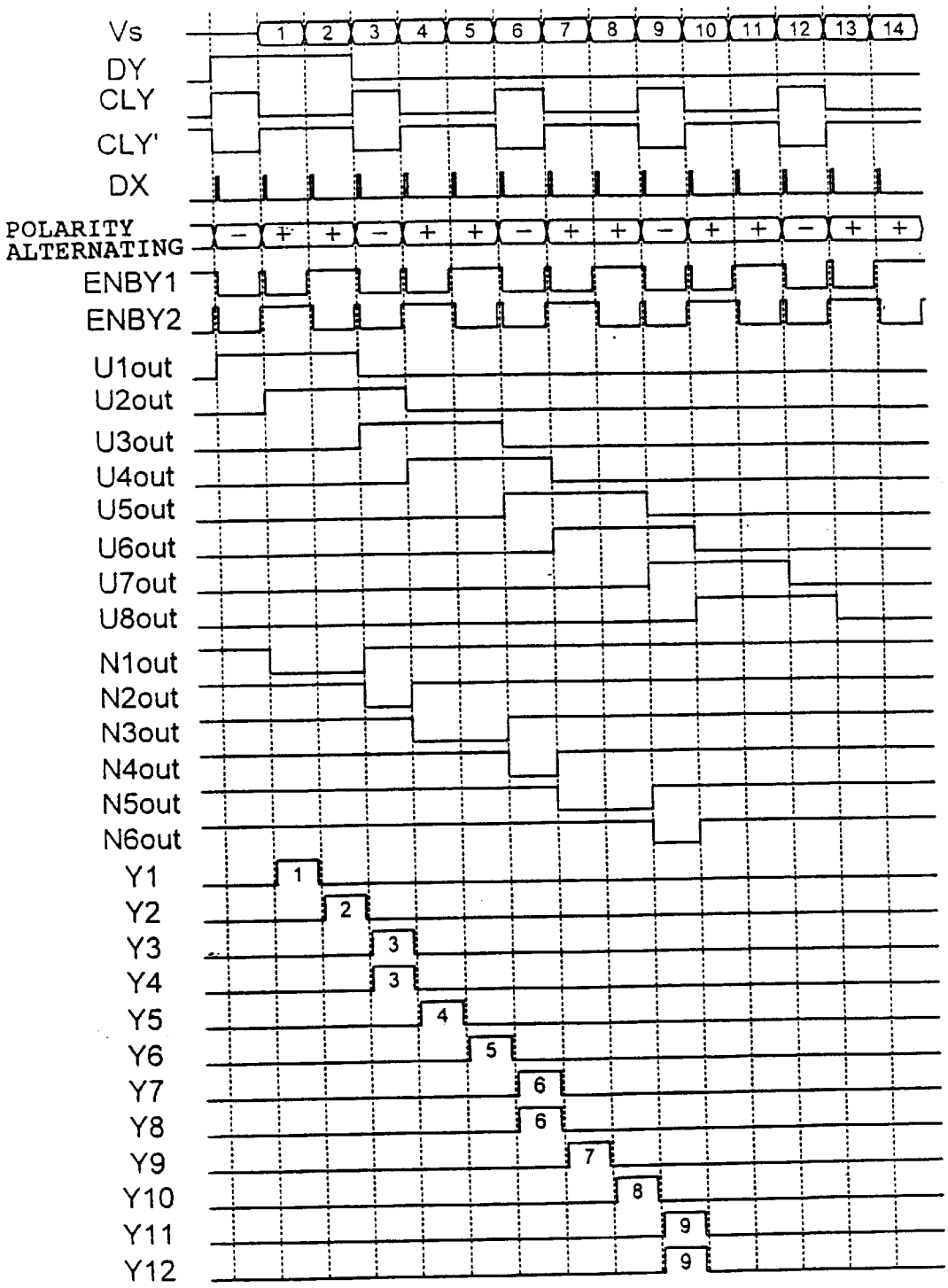

[FIG. 11]
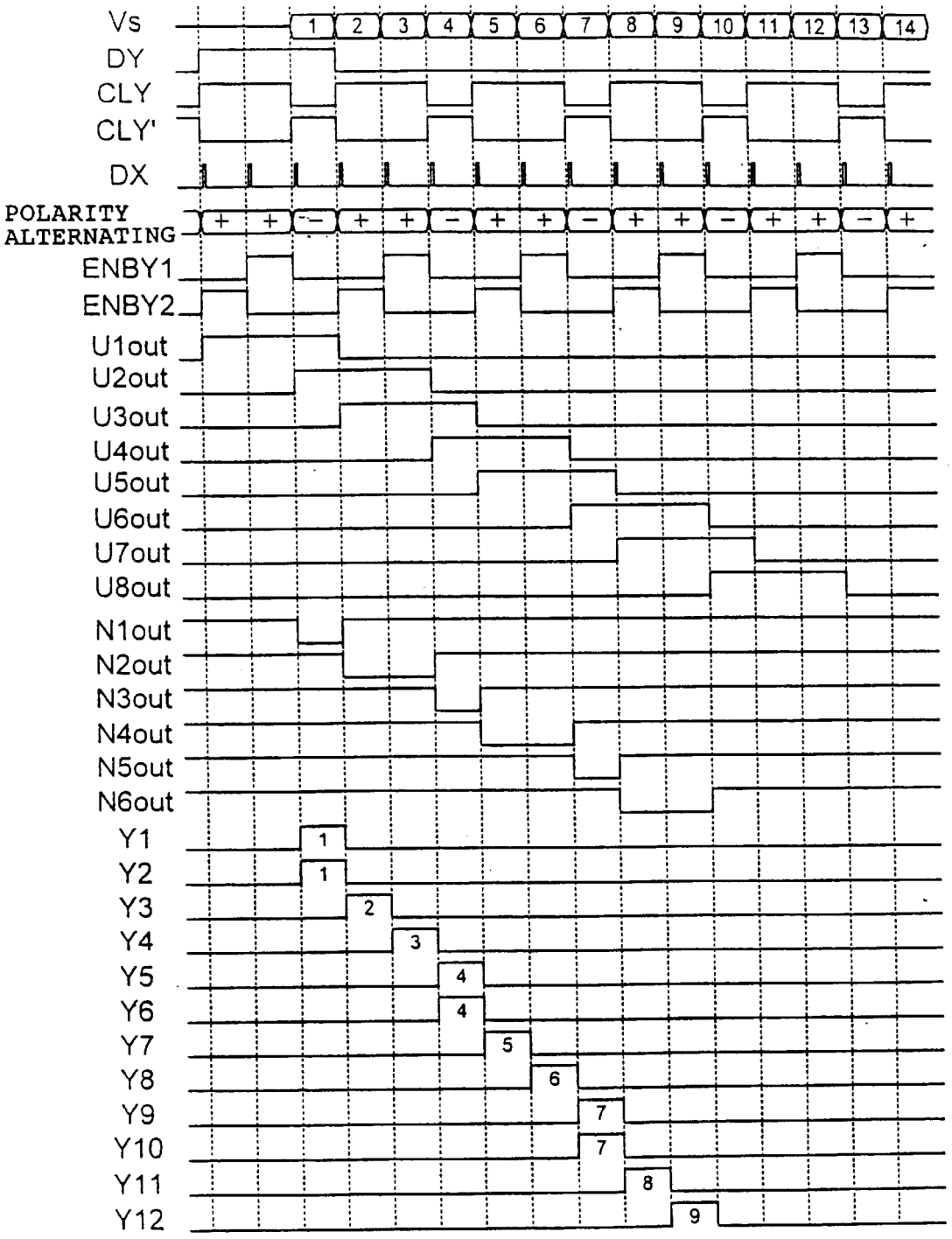

[FIG. 12]
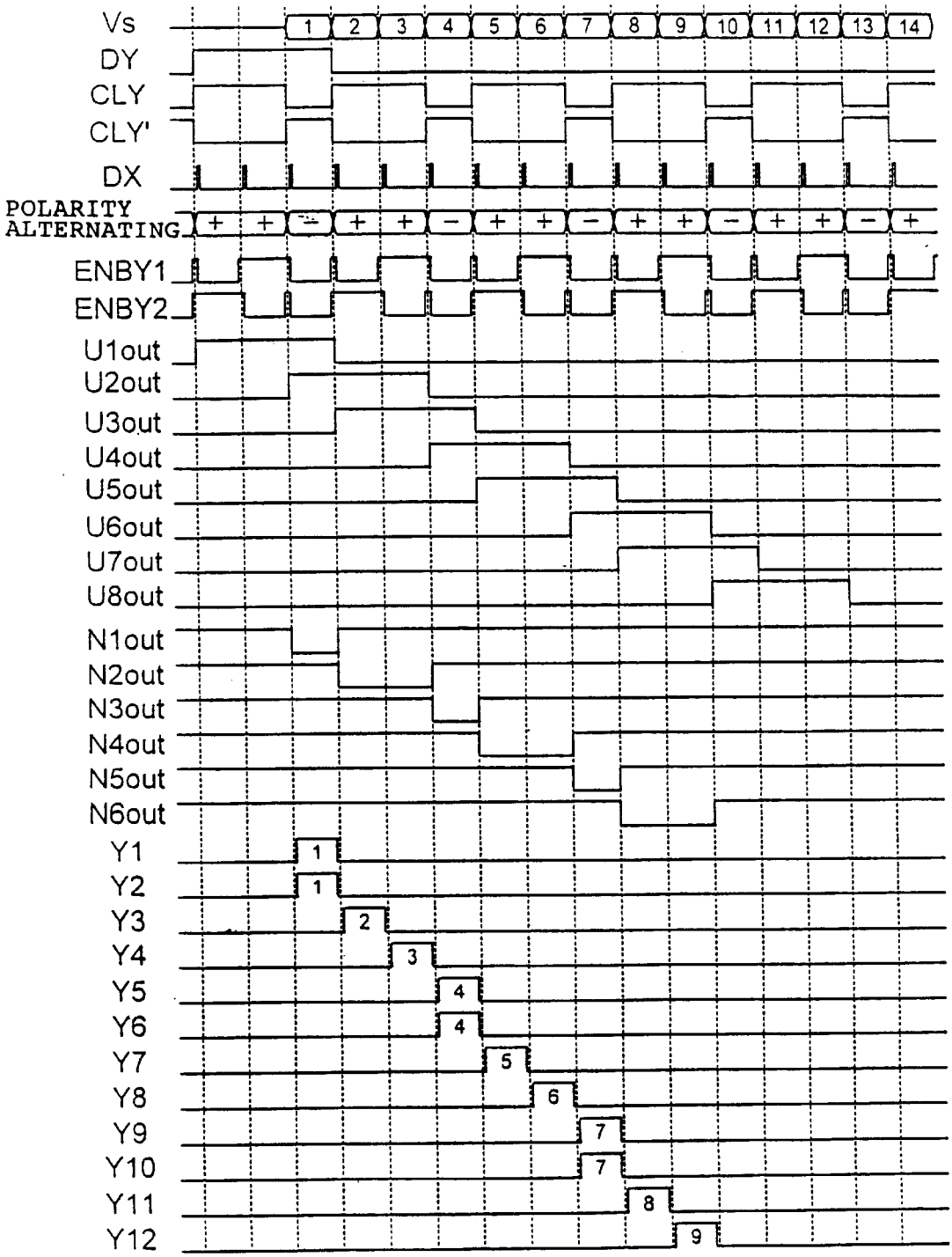

[FIG. 13]
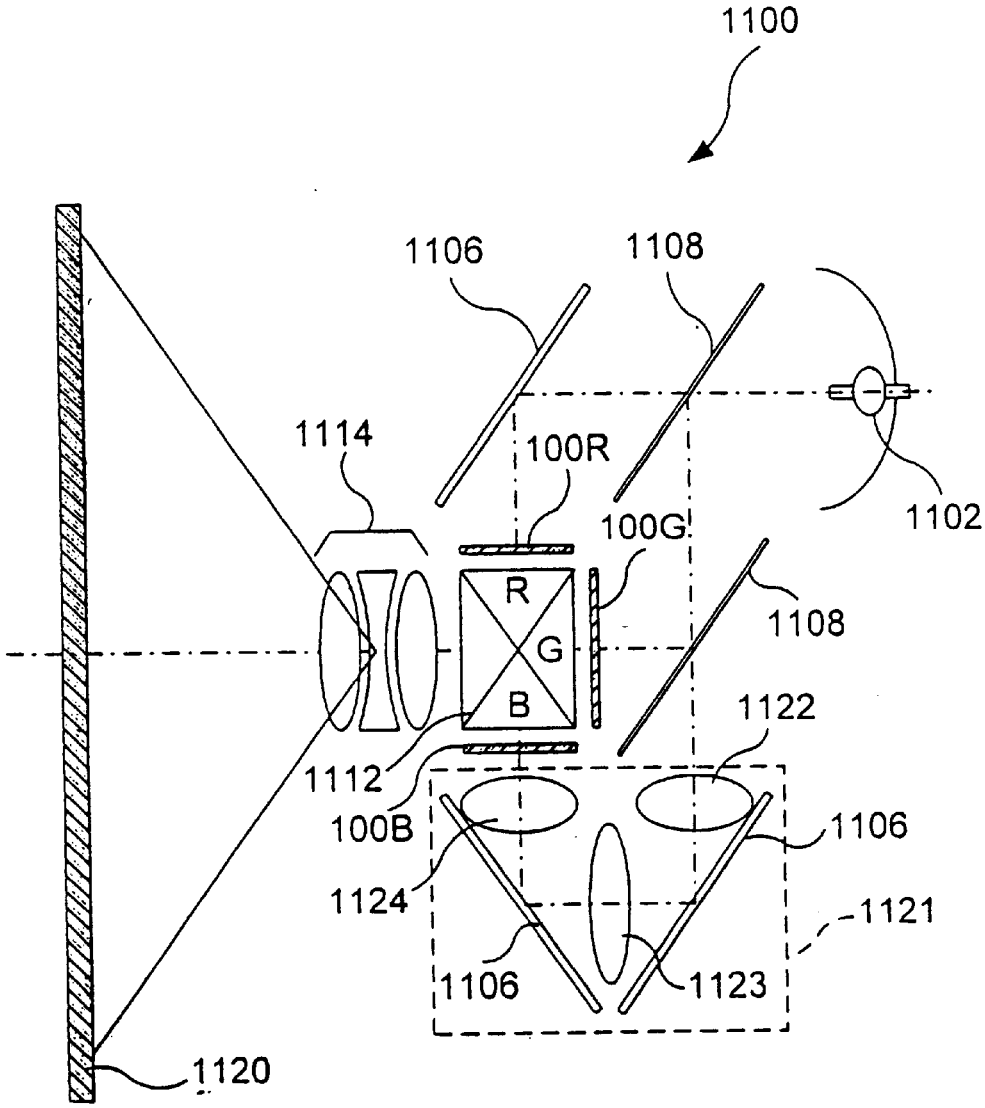

ELECTRO-OPTICAL DEVICE, METHOD FOR DRIVING THE SAME, SCANNING LINE DRIVING CIRCUIT, AND ELECTRONIC EQUIPMENT

BACKGROUND OF THE INVENTION

1. Field of Invention

The present invention relates to an active-matrix electro-optical device, a method for driving the active-matrix electro-optical device, a scanning line driving circuit, and electronic equipment.

2. Description of Related Art

Active-matrix electro-optical devices typically include a plurality of scanning lines and a plurality of data lines, respectively extending horizontally and vertically, and a switching element, such as a thin-film diode (hereinafter referred to as "TFD") or a thin-film transistor (hereinafter referred to as "TFT") arranged at each of intersections of the scanning lines and the data lines.

The scanning lines are successively provided with a scanning signal by a scanning line driving circuit. The data lines are driven by a data line driving circuit. In synchronization with a successive supply of the scanning signal, the data line driving circuit feeds a sampling control signal to a sampling switch that samples, on a data-line-by-data-line basis, a video signal supplied to a video signal line.

In such an active-matrix electro-optical device, a vertical scanning operation on a field-by-field basis or on a frame-by-frame basis, i.e., a field scanning or a frame scanning, is performed in response to the scanning signal and the sampling control signal.

The video signal input to the electro-optical device may be a signal of any of the digital TV system and the like other than the NTSC system, the PAL system, SECAM system, and high-vision system. The number of video lines of the video signal is different from television system to television system. The electro-optical device compatible with a plurality of television systems thus includes a video line count converter. Using the video line count converter, the number of lines of the input video signal is converted to correspond with the number of scanning lines of the active matrix, and the converted video signal is used to drive the scanning line driving circuit and the data line driving circuit.

SUMMARY OF THE INVENTION

The video line count converter typically employs a field memory or a frame memory for converting the video line count, and generally increases the scale of the circuit of the entire electro-optical device. Particularly, a device, such as a video projector, in need of three processing circuits corresponding to the three RGB colors, disadvantageously requires the tripled circuit scale of the video line converter to perform process for the three colors.

The present invention has been developed at least in view of this problem, and it is an object of the present invention to at least provide an electro-optical device which converts the video line count without using a video line count converter, a method for driving the electro-optical device, a scanning line driving circuit, and electronic equipment.

One exemplary embodiment of the present invention lies in a method for driving an electro-optical device that includes a pixel including a switching element arranged at each of intersections of a plurality of scanning lines and a plurality of data lines, and a pixel electrode connected to the switching element, a scanning signal for driving each of the plurality of the scanning lines being preferably generated in accordance with the video line count per field of an input video signal and a scanning line count.

In accordance with this exemplary embodiment of the present invention, the scanning signals are generated in accordance with the video line count per field of the input video signal and the scanning line count. A decimation process is thus performed by deactivating the scanning signal for particular video lines of the video signal or a stretching process is performed by concurrently activating the scanning signal supplied to adjacent scanning lines for the particular video lines. With this arrangement, even if the video line count of the input video signal fails to coincide with the scanning line count, the input video signal is presented on the electro-optical device without the need for the converter for converting the video line count.

In the generation step of the scanning signal in the driving method, all scanning signals may be deactivated for the particular video lines predetermined in accordance with the detected video line count and the scanning line count. Since the scanning signals for the particular video lines are deactivated, the video signal of the particular video lines is not written on pixels. The particular video lines are thus decimated.

The driving of the data line is preferably suspended for the particular video line while the data lines are driven on the video lines other than the particular video lines. Since the video signal is not written on the particular video line, the data line does not need driving. The suspension of the driving of the data line for the particular video line creates no problem, and provides the advantage of reducing power consumption.

In the generation step of the scanning signal in the driving method, two scanning signals for driving adjacent scanning lines are preferably concurrently activated for the particular video lines predetermined in accordance with the detected video line count and scanning line count. Since the two scanning signals for driving the adjacent scanning lines for the particular video lines are concurrently activated, the switching elements connected to the adjacent scanning lines are concurrently turned on, and the video signal is written on the video lines corresponding to the two scanning lines. The arrangement achieves the stretching process.

Another exemplary embodiment of the present invention lies in a method for driving an electro-optical device that includes a pixel including a switching element arranged at each of intersections of a plurality of scanning lines and a plurality of data lines, and a pixel electrode connected to the switching element, the video line count per field of the input video signal being detected, the scanning signals for driving the scanning lines being successively generated when the detected video line count is equal to the scanning line count, and the scanning signals for the particular video lines predetermined in accordance with the detected video line count and the scanning line count being deactivated when the detected video line count exceeds the scanning line count, while two scanning signals for driving adjacent scanning lines being concurrently activated for the video lines other than the particular video lines.

In accordance with this exemplary embodiment of the present invention, the video signal for the particular video lines is decimated while the other lines are twice stretched. When the video signal, having the video line count equal to the scanning line count, is input, the video signal is presented without the need for the decimation process or the stretching process. When both line counts fail to coincide with each other, the decimation process or the stretching process is performed by controlling the scanning signal. For instance, when a video signal having 540 lines per field is input against a scanning line count of 720, the decimation process is carried out to decimate one line every three lines, while the stretching process for stretching the lines is performed.

Another exemplary embodiment of the present invention lies in a method for driving an electro-optical device that includes a pixel including a switching element arranged at each of intersections of a plurality of scanning lines and a plurality of data lines, and a pixel electrode connected to the switching element, the video line count per field of the input video signal being detected, the scanning signals for driving the scanning lines being successively generated when the detected video line count is equal to the scanning line count, and two scanning signals for driving adjacent scanning lines for the particular video lines predetermined in accordance with the detected video line count and the scanning line count being concurrently activated when the detected video line count exceeds the scanning line count.

Since the video signal of the particular video lines is written on the pixels connected to the two scanning lines in accordance with this exemplary embodiment of the present invention, the particular video lines are twice stretched. When the video signal, having the video line count equal to the scanning line count, is input, the video signal is presented without the need for the decimation process or the stretching process. When both line counts fail to coincide with each other, the decimation process or the stretching process is performed by controlling the scanning signal. For instance, when a video signal having 540 lines per field is input against a scanning line count of 720, the stretching process is carried out on one line every three lines for image presentation.

Another exemplary embodiment of the present invention lies in a scanning line driving circuit of an electro-optical device includes a pixel including a switching element arranged at each of intersections of a plurality of scanning lines and a plurality of data lines, and a pixel electrode connected to the switching element. The scanning line driving circuit includes a shift device which successively outputs a transfer signal by transferring a start pulse in response to a clock signal, and an output selection device which generates a scanning signal for driving a respective scanning line by selecting a predetermined duration within an active period of the transfer signal, based on an enable signal that is generated in accordance with the video line count of the input video signal and the scanning signal line count.

In accordance with this exemplary embodiment of the present invention, provided with the enable signal, the output selection device generates the scanning signal for driving the respective scanning line by selecting the predetermined duration within the active period of the transfer signal generated by the shift device. The scanning signal is thus flexibly controlled by the enable signal. Since the enable signal is generated in accordance with the video line count of the input video signal and the scanning line count, the decimation process or the stretching process is performed by controlling the scanning signal even if the video line count of the input video signal and the scanning line count fail to coincide with each other.

The output selection device includes a plurality of unit circuits corresponding to the respective transfer signals, and the unit circuit includes a plurality of branch lines to which the transfer signal is distributed, and a logic circuit, arranged for each branch line, for generating a signal that is activated only when the transfer signal distributed along the branch line and the enable signal are concurrently activated, and for outputting the signal as the scanning signal.

An electro-optical device of another exemplary embodiment of the present invention includes the scanning line driving circuit, a detecting device for detecting the video line count per field of the input video signal, and a signal generator for generating an enable signal which is responsive to the detected video line count and the scanning line count, and which is deactivated for predetermined durations of time prior to and subsequent to the timing of line switching.

Since the enable signal is deactivated for predetermined durations of time prior to and subsequent to the timing of line switching with this arrangement, the scanning signal is also deactivated throughout these durations. As a result, this arrangement reliably prevents the scanning signals from overlapping each other in the active periods thereof, thereby improving image quality.

An electro-optical device of another exemplary embodiment of the present invention includes a scanning line driving circuit, a detecting device for detecting the video line count per field of the input video signal, and a signal generator for generating an enable signal which is deactivated for particular video lines predetermined in accordance with the detected video line count and the scanning line count.

In accordance with this exemplary embodiment of the present invention, the scanning signals are generated in accordance with the video line count per field of the input video signal and the scanning line count. A decimation process is thus performed by deactivating the scanning signal for the particular video lines of the video signal or a stretching process is performed by concurrently activating the scanning signal supplied to adjacent scanning lines for the particular video lines. With this arrangement, even if the video line count of the input video signal fails to coincide with the scanning line count, the input video signal is presented on the electro-optical device without the need for the converter for converting the video line count.

The electro-optical device preferably includes a data line driving circuit for driving the data line in accordance with the shift signal that is generated by successively transferring a start pulse in response to a clock signal, wherein the signal generator supplies the data line driving circuit with the start pulse for the video lines other than the particular video lines while stopping the supplying of the start pulse to the data line driving circuit for the particular video lines.

With this arrangement, the start pulse is not supplied to the data line driving circuit in connection with the particular video lines not contributed to image presentation, and the data line driving circuit suspends the transfer operation thereof. The power consumption of the data line driving circuit is thus reduced.

An electro-optical device of another exemplary embodiment of the present invention includes the scanning line driving circuit, a detecting device for detecting the video line count per field of the input video signal, and a signal generator for generating an enable signal which concurrently activates two scanning signals for driving adjacent scanning lines for the particular video lines predetermined in accordance with the detected video line count and the scanning line count. With this arrangement, the stretching process is performed by controlling the scanning signal in accordance with the video line count of the input video signal.

An electro-optical device of another exemplary embodiment of the present invention for alternating the polarity of a video signal to be written to pixels according to the unit of at least one scanning line, includes a polarity control device for controlling the electrode of the video signal on a line-by-line basis for the particular video lines so that the number of scanning lines supplied with a positive video signal is equal to the number of scanning lines supplied with a negative video signal.

With this arrangement, the polarity inversion of the video signal is performed in consideration of the particular video lines to be subjected to the decimation process or the stretching process. For instance, the stretching process is performed on one line out of the three lines, the video signal of the positive polarity is fed to two consecutive lines, and then the video signal of the negative polarity is fed to two consecutive lines.

An electro-optical device of another exemplary embodiment of the present invention inputting an input composite video signal and presenting an image on a display area, includes a video line count detector circuit for detecting the video line count of the input video signal per field or per frame, and a signal processing circuit for comparing a signal detected by the video line count detector circuit with a line count of the display area of the electro-optical device, and for processing a particular video line of the input composite video signal in accordance with the line count of the display area to convert the composite video signal into a component video signal.

The signal processing circuit of the electro-optical device converts the input composite video signal, having a video line count smaller than the line count of the display area, into a component video signal in a manner such that the particular video line of the input video signal is presented on a plurality of lines of the display area.

The signal processing circuit of the electro-optical device converts the input composite video signal, having a video line count greater than the line count of the display area, into a component video signal in a manner such that the particular video line of the input video signal is not presented on the lines of the display area.

An electro-optical device of another exemplary embodiment of the present invention receiving an input composite video signal and presenting an image on a display area, includes a determining circuit for determining the type of the input composite video signal, and a signal processing circuit for generating a component video signal in accordance with the line count of the display area, based on the determination result provided by the determining circuit and the line count of the display area of the electro-optical device.

Electronic equipment of various exemplary embodiments of the present invention includes the above-discussed electro-optical devices. For instance, the electronic equipment may be a video projector, a liquid-crystal television, a viewfinder type or direct monitoring type video cassette recorder, a car navigation system, a pager, a word processor, a workstation, a video telephone, etc.

BRIEF DESCRIPTION OF THE DRAWINGS

FIG. 1 is a block diagram generally showing the construction of a liquid-crystal device of one exemplary embodiment of the present invention.

FIG. 2 is a block diagram showing the liquid-crystal panel of the liquid-crystal device of the exemplary embodiment of the present invention.

FIG. 3 is a timing chart showing video signals VID1–VID6 in the liquid-crystal device of the exemplary embodiment of the present invention.

FIG. 4 is a circuit diagram showing a scanning line driving circuit in the liquid-crystal device of the exemplary embodiment of the present invention.

FIG. 5 is a timing chart illustrating an exemplary operation of the liquid-crystal device when an effective video line count of the input video signal coincides with a scanning line count of the liquid-crystal panel.

FIG. 6 is a timing chart when the scanning signals have no overlapping portion therebetween in FIG. 5.

FIG. 7 is a timing chart illustrating an exemplary operation of a first exemplary embodiment of the liquid-crystal device when the effective video line count of the input video signal does not coincide with the scanning line count of the liquid-crystal panel.

FIG. 8 is a timing chart when the scanning signals have no overlapping portion therebetween in FIG. 7.

FIG. 9 is a timing chart illustrating an exemplary operation of a second exemplary embodiment of the liquid-crystal device when the effective video line count of the input video signal does not coincide with the scanning line count of the liquid-crystal panel.

FIG. 10 is a timing chart when the scanning signals have no overlapping portion therebetween in FIG. 9.

FIG. 11 is a timing chart illustrating an exemplary operation of a third exemplary embodiment of the liquid-crystal device when the effective video line count of the input video signal does not coincide with the scanning line count of the liquid-crystal panel.

FIG. 12 is a timing chart when the scanning signals have no overlapping portion therebetween in FIG. 11.

FIG. 13 is a plan view showing a liquid-crystal projector employing the liquid-crystal device of the various exemplary embodiments of the present invention.

DETAILED DESCRIPTION OF PREFERRED EMBODIMENTS

The exemplary embodiments of the present invention are now discussed, referring to the drawings. In the following exemplary embodiments, an electro-optical device is a TFT-driven, active-matrix, liquid-crystal device employing a liquid crystal as an electro-optical material. However, it is to be appreciated that the present invention is not limited to these exemplary embodiments.

FIG. 1 is a block diagram showing the general construction of the liquid-crystal device of an exemplary embodiment of the present invention. As shown, the liquid-crystal device A includes, as major components thereof, a liquid-crystal display panel 100, an external processing unit 200, and a power source circuit 300.

The liquid-crystal display panel 100 includes a display area for presenting an image thereon, as will be discussed later, and the driving circuit therefor is formed on a TFT element substrate.

The external processing unit 200 includes a video line count detector circuit 210 as a detecting device, a signal processing circuit 220 as signal generator, and a serial-to-parallel converter circuit 230.

The video line count detector circuit 210 detects a horizontal video line count of an input video signal Vin within one field period or one frame period, and outputs the detected signal Hn to the signal processing circuit 220 and the serial-to-parallel converter circuit 230. The input video signal Vin may be any of a variety of composite signals of the NTSC system, the PAL system, the SECAM system, the high-vision system, and the digital TV system.

The signal processing circuit 220 includes an RGB decoder and PLL circuits (not shown), demodulates an input composite video signal Vin into component video signals Vs corresponding to the RGB colors, and outputs the component video signals to the serial-to-parallel converter circuit 230. In synchronization with the input video signal Vin, the signal processing circuit,220 generates a variety of control signals including a Y clock signal CLY, an X clock signal CLX, and further first and second enable signals ENBY1 and ENBY2. The Y clock CLY is a reference signal for controlling a shift register of the scanning line driving circuit, and the X clock CLX is a reference signal for controlling a shift register of the data line driving circuit. The first and second enable signals ENBY1 and ENBY2 control the scanning line drive operation of the liquid-crystal display panel 100. As will be discussed in detail later, a particular video line of the video signal is presented on a plurality of lines on the liquid-crystal display panel 100 (a stretching process) or the particular video line of the video signal is not presented (a decimation process) when the scanning line driving circuit drives the scanning lines in response to the first and second enable signals ENBY1 and ENBY2.

The first and second enable signals ENBY1 and ENBY2 are generated in accordance with the video line count indicated by the detected signal Hn and the scanning line count of the liquid-crystal display panel 100. The stretching process and the decimation process are performed by converting the video line count of the input video signal Vin in order to match the video line count of the input video signal Vin with the scanning line count of the liquid-crystal display panel 100 when the scanning line count of the liquid-crystal display panel 100 fails to coincide with the video line count of the input video signal Vin. A particular video line of the input video signal Vin to be subjected to the stretching process or the decimation process needs to be determined so that the video line count per field is smoothly converted to match the scanning line count of the liquid-crystal display panel 100. The particular video line is thus determined in accordance with the video line count of the input video signal Vin per field and the scanning line count of the liquid-crystal display panel 100. The first and second enable signals ENBY1 and ENBY2 are used to generate the scanning signal so that the stretching process or the decimation process is performed for the particular video line. The first and second enable signals ENBY1 and ENBY2 are thus generated in accordance with the video line count indicated by the detected signal Hn and the scanning line count of the liquid-crystal display panel 100. Since the scanning line count of the liquid-crystal display panel 100 is known, the first and second enable signals ENBY1 and ENBY2 can be generated in response to the detected signal Hn.

The signal processing circuit 220 has a variety of waveform patterns in preparation to be used as the first and second enable signals ENBY1 and ENBY2, and selects them in response to the detected signal Hn. Alternatively, a counter is arranged, and based on the output signal and the detected signal Hn, the first and second enable signals ENBY1 and ENBY2 are generated.

The serial-to-parallel converter circuit 230 is composed of a sample-and-hold circuit, and converts a one-line video signal Vs into a plurality of lines of video signal VIDs. In the exemplary embodiment shown in FIG. 1, the serial-to-parallel converter circuit 230 produces six lines of video signals VID1–VID6.

Since the liquid crystal has the feature that transmissivity characteristic thereof is degraded with a direct current applied thereon, alternating current driving is performed in which the polarity of the applied voltage is thus alternated with a certain period. The video signal Vs, fed to the serial-to-parallel converter circuit 230, is alternated in polarity with a certain period. For instance, the polarity of the applied voltage alternates across adjacent scanning lines, and further alternates with the period of field. If the above-discussed stretching process or decimation process is performed, the order of the video signal fed to the scanning lines becomes erratic at the particular video line where a particular driving is performed. For this reason, the signal processing circuit 220 outputs the video signal Vs that is inverted in polarity in accordance with the stretching process or the decimation process of the particular video line. Since the stretching process or the decimation process of the particular video line is performed in response to the detected signal Hn, the detected signal Hn determines which line to set to be positive and which line to set to be negative.

The power source circuit 300 is composed of a constant voltage regulator etc., and generates a power supply voltage to be fed to the drive circuit of the liquid-crystal display panel 100 and the above-referenced external processing unit 200.

The liquid-crystal display panel 100 is now discussed. FIG. 2 is a block diagram showing an exemplary construction of the liquid-crystal display panel 100. As shown, the liquid-crystal display panel 100 includes a display area la, a data line driving circuit 101, a scanning line driving circuit 104, and a sampling circuit 301.

From among these units, the data line driving circuit 101, the scanning line driving circuit 104, and the sampling circuit 301 are arranged on a peripheral area of the display area 1*a* on a TFT array substrate 10 fabricated of a quartz substrate, a hard glass substrate, or a silicon substrate, for instance.

As shown in FIG. 2, a plurality of data lines 35 are formed along the X direction and extend in the Y direction, on the display area la on the TFT array substrate 10. A plurality of scanning lines 31 extend in the X direction, as shown in FIG. 2. A pixel electrode 11 is arranged at each of intersections of the data lines 35 and the scanning lines 31.

The pixel electrodes 11 are thus arranged in a matrix expanding in the X direction and in the Y direction. Connected to each pixel electrode 11 is a TFT 30 which controls the conduction between the pixel electrode 11 and the data line 35 to be closed or opened, in response to the scanning signal supplied through the scanning line 31 thereto. Capacitive lines 32 are arranged in parallel with the scanning lines 31 on the TFT array substrate 10, and form a storage capacitor 70 to store a voltage applied to the pixel electrode 11 for a long period of time. In this exemplary embodiment, 720 of the scanning lines 31 and 1280 of the data lines 35 are formed in the internal area within the frame which defines the display area of the liquid crystal display panel 100. Furthermore, the count of the scanning lines 31 of the display area may be 768 in order to display an XGA mode (768 to 1024). In this case, a 720P digital TV signal display can be realized by performing the stretching process on the scanning line driving circuit 104. A dummy pixel may be formed by providing dummy scanning lines 31, dummy data lines 35, dummy pixel electrodes 11, and dummy TFTs 30 in the frame area in order to drive the liquid crystal constantly.

The data line driving circuit 101, as a driving circuit for the data lines 35 (on the X side), is composed of a shift register. The data line driving circuit 101 transfers a start pulse DX in response to a clock signal CLX (and its inverted clock CLX'), i.e., a reference clock signal on the X side, thereby successively generating and outputting sampling control signals to sampling control signal lines 307. The data line driving circuit 101 receives a transfer direction control signal DIRX and a reverse transfer direction control signal DIRX'. When supplied with the transfer direction control signal DIRX, the data line driving circuit 101 shifts the start pulse DX in a forward direction thereof, thereby successively generating the sampling control signal. When supplied with the reverse transfer direction control signal DIRX', the data line driving circuit 101 shifts the start pulse DX in a reverse direction thereof, thereby successively generating the sampling control signal.

In this exemplary embodiment, serial-to-parallel converted video signals VID1–VID6 are output to a plurality of video signal lines 401. One sampling control signal is supplied to a plurality of (six in this embodiment) sampling switches 302.

Specifically, one line video signal Vs is stretched by six times along the time axis by the external processing unit 200, and is successively distributed on the six video signal lines 401 as the video signals VID1–VID6. FIG. 3 shows an exemplary relationship between the video signals VID1–VID6 and the video signal Vs. The sampling control signal of the data line driving circuit 101 is supplied to six adjacent sampling switches 302 via the sampling control signal line 307 which is branched into six lines.

With this arrangement, when the sampling control signal S1 is driven to an H level, six sampling switches 302 of a first through sixth from the left in FIG. 2 are concurrently turned on. The video signals VID1–VID6 are respectively sampled by the first through sixth data lines 35, and are written through TFTs 30 connected to the scanning line 31 selected throughout the corresponding horizontal scanning period. When a sampling control signal S2 is driven to an H level, six sampling switches 302 of the seventh through twelfth are concurrently turned on. The video signals VID1–VID6 are respectively sampled by the seventh through twelfth data lines 35, and are written through TFTs 30 connected to the scanning line 31 selected through the corresponding horizontal scanning period. Similar operations are repeated thereafter.

In this exemplary embodiment, the serial-to-parallel conversion number of the video signal is "six", and thus, "six" sampling switches 302 are concurrently driven. The conversion number (or the number of sampling switches 302 driven concurrently) may be determined depending on the performance of the sampling switch 302. If the sampling performance of the sampling switch 302 is high, the (serial-to-parallel unconverted) video signal Vin is successively supplied to the data lines 35. If the sampling performance is low, the video signal Vs is serial-to-parallel converted into two or more lines, and is distributed to two or more data lines 35. The conversion number is preferably a multiple of three to simplify control and circuitry, because a color video signal is constructed of the three colors.

The scanning line driving circuit 104, as a driving circuit for the scanning lines 31 (on the Y side), successively generates the scanning signals in response to the clock signal CLY (and its inverted clock signal CLY') as a reference signal on the Y side, and respectively outputs the scanning signals to the scanning lines 31. In response to the transfer direction control signal DIRY (and its reverse transfer direction control signal DIRY'), the scanning line driving circuit 104 supplies the scanning lines 31 with the scanning signals in the order of top to bottom or from bottom to top. The transfer direction control signal DIRY (and its reverse transfer direction control signal DIRY') indicates a downward scanning from top to bottom when at an L level, and indicates an upward scanning from bottom to top when at an H level, for instance.

FIG. 4 is a block diagram showing an exemplary construction of the scanning line driving circuit 104. As shown in FIG. 4, the scanning line driving circuit 104 includes a transfer direction control circuit 141, a shift register 142 as a shift device, and an output selection circuit 143 as an output selection device or a polarity control device.

The transfer direction control circuit 141 is produced by configuring N-channel TFTs in serial connection in two lines, and the transfer direction control signal DIRY and the reverse transfer direction control signal DIRY' are alternately added to the gates of the N-channel TFTs. When the reverse transfer direction control signal DIRY' remains at an H level, all N-channel TFTs supplied with the reverse transfer direction control signal DIRY' are turned on, while all N-channel TFTs supplied with the transfer direction control signal DIRY are turned off. The start pulse DY is thus transferred in the direction represented by arrows, and the scanning signal is fed to the plurality of scanning lines 31 from top to bottom. Conversely, when the reverse transfer direction control signal DIRY' is driven to an L level, conducted N-channel TFTs and non-conductive TFTs are reversed. In this case, the scanning signal is fed to the plurality of scanning lines 31 from bottom to top.

The shift register 142 is composed a plurality of unit circuits U1, U2, . . . , Um+1 and NAND gates N1, N2, . . . , Nm, each of which receives output signals from adjacent unit circuits. Each of the unit circuits U1, U2, . . . , Um+1 is composed of an N-channel TFT Na supplied with the clock signal CLY, an N-channel TFT Nb supplied with the inverted clock signal CLY', and inverters INV1 and INV2. Since the number of the scanning lines 31 is 720, m=360.

When the clock signal CLY is in the H-level period thereof, the N-channel TFT Na is turned on, transferring the input signal to the output thereof through the inverters INV1 and INV2. Then, when the clock signal CLY is transitioned from an H-level to an L-level, the inverted clock signal CLY' is driven to an H-level, and the N-channel TFT Nb is turned on. A latch circuit is then formed of the N-channel TFT Nb and the inverters INV1 and INV2. The logic level of the output signal thus remains at an H-level even when the inverted clock signal CLY' is in the H-level period thereof. In other words, each of the unit circuits U1, U2, . . . , Um+1 latches the input signal for one period of the clock signal CLY.

When the scanning line driving circuit 104 receives the start pulse DY, the clock signal CLY and the inverted clock signal CLY' shown in FIG. 5 with the transfer direction control signal DIRY at an L level, the unit circuits U1, U2, . . . produce output signals U1out, U2out, . . . , Um+1out. As shown in FIG. 5, the H-level duration of the output signal U1out, U2out, . . . , Um+1 out corresponds with one period of the clock signal CLY. The output signals U1out, U2out, . . . overlap one from the next by the H-level duration of the inverted clock signal CLY'. The NAND gates N1, N2, . . . , Nm respectively NAND-gate the output signals of two adjacent unit circuits, thereby producing output signal N1out, N2out, . . . , Nmout, as shown in waveform diagram in FIG. 5.

The output selection circuit 143 is composed of a plurality of unit circuits U1', U2', . . . Um'. Each of the unit circuits U1', U2', . . . , Um' is composed of NOR gates NR1 and NR2, and inverters INV3–INV6. The output signal of the shift register is fed to one input terminal of each of the NOR gates NR1 and NR2. The first enable signal ENBY1 is fed to the other input terminal of the NOR gate NR1, and the second enable signal ENBY2 is fed to the other input terminal of the NOR gate NR2. With the logic levels of the first enable signal ENBY1 and the second enable signal ENBY2 appropriately set, each unit circuit can produce the output signal thereof by selecting a desired duration from the L-level (active) durations of the input signal. Referring to FIG. 5, for instance, the unit circuits U1', U2', . . . , Um' output the scanning signals Y1, Y2, . . . with the active durations thereof successively shifting every scanning period (1H).

The output selection circuit 143 time-divides a single input signal into two-line signals, and the time division number K (K is a natural number more than 1) may be any number. In this case, the number of enable signals increases in accordance with the division number. The more the time division number, the less the number of the stages of the shift register 142, and the less the number of the N-channel TFTs constituting the transfer direction control circuit 141. With the division number K, both the number of the stages of the shift register 142 and the number of the N-channel TFTs constituting the transfer direction control circuit 141 can be set to 1/K. In this way, a circuit pitch of the scanning line driving circuit 104 is easily narrowed, and it is advantageous to miniaturize the liquid crystal device.

The operation of the liquid-crystal device is now discussed. In the discussion that follows, a first case and a second case are contemplated, wherein the device is supplied with a digital TV signal having 720 effective lines per field as the input video signal Vin in the first case, and the device is supplied with a High-Vision signal having 540 effective lines per field as the input video signal Vin in the second case.

In this case, the effective video line count of the input video signal Vin corresponds with the count of the scanning lines 31 (720 lines) of the liquid-crystal display panel 100. FIG. 5 is a timing chart showing the operation of the liquid-crystal device. It is now assumed that the transfer direction control signal DIRY is at an L level.

When the liquid-crystal device A is supplied with the input video signal Vin, the video line count detector circuit 210 detects the video line count of the input video signal Vin, thereby generating a detected signal Hn. In response to the detected signal Hn, the signal processing circuit 220 generates the first enable signal ENBY1 and the second enable signal ENBY2 shown in FIG. 5. Furthermore, the signal processing circuit 220 performs polarity inversion in response to the detected signal Hn, as shown in FIG. 5.

The first enable signal ENBY1 alternates every line, and the second enable signal ENBY2 is an inverted version of the first enable signal ENBY1. For a duration T1, for instance, when the signal N1out, as the first output signal of the shift register 142, is transitioned to an L level, the scanning signal Y1 is driven to an H-level for the first half of the duration T1 and the scanning signal Y2 is driven to an H-level for the second half of the duration T1. In other words, the shift register 142 generates a signal that remains at an L (active) level for two horizontal scanning periods, and the scanning signal Y1 and the scanning signal Y2 are produced by selecting the signal using the first enable signal ENBY1 and the second enable signal ENBY2. This operation is repeated to generate the scanning signals Y1, Y2, . . . , Y720 for successively selecting the scanning lines 31 for every one horizontal scanning period.

As discussed above, with the first enable signal ENBY1 and the second enable signal ENBY2 mutually inverted from each other, the falling edge of one scanning signal, i.e., Y1, and the rising edge of the next scanning signal, i.e., Y2, are at the same timing as shown in FIG. 5.

In practice, however, the edges of the scanning signals Y1, Y2, . . . have a slope determined by the response characteristics of the TFTs constituting the data line driving circuit 101. For this reason, the H-level durations of the scanning signals Y1, Y2, . . . may partly overlap each other. This suggests that the video signal is concurrently written on adjacent scanning lines 31 in the overlap period. For instance, if the H level durations of the scanning signal Y1 and the scanning signal Y2 partly overlap each other, a portion of the video signal corresponding to the first line is mixed with the video signal corresponding to the second line, and is written on the pixels corresponding to the second line. The same thing can happen on other lines. The device suffers from image degradation if the falling edges and the rising edges of the scanning signals Y1, Y2, . . . are set to be at the same timing.

To cope with this problem, the L-level duration may be set to be shorter than the H-level duration in the period of the first and second enable signals ENBY1 and ENBY2 so that the scanning signals Y1, Y2, . . . do not overlap each other.

FIG. 6 is a timing chart showing an exemplary operation of the liquid-crystal device with this technique incorporated. Referring to FIG. 6, a duration T2 corresponds to a second horizontal scanning period, and for a duration T2', which is a portion of the duration T2, the second enable signal ENBY2 remains at an L level. The scanning signal Y2 is transitioned to an H level for the duration T2'. The duration during which each of the other scanning signals remains at an H-level is limited to a portion of one horizontal scanning period equal to the duration T2'. In other words, the first enable signal ENBY1 and the second enable signal ENBY2 are set to be inactive for a predetermined duration of time at the switching timing of the video signal line. This arrangement prevents the scanning signals Y1, Y2, . . . from overlapping each other for the H-level durations thereof. As a result, the image is improved in quality.

In this case, the liquid-crystal device A receives the input video signal Vin having 540 lines per field. On the other hand, the liquid-crystal device A has 720 scanning lines. The liquid-crystal device A having the scanning line count different from the video line count of the input video signal Vin presents the input video signal Vin. The following three exemplary embodiments in this case are contemplated.

In a first exemplary embodiment, the input video signal Vin having the 540 lines per field is subjected to a decimation process to decimate one line per three lines, and a 360-line video signal thus results. The video signal of each line resulting from the decimation process is subjected to the stretching process to stretch the video signal across two vertically adjacent scanning lines. In this way, the 360-line video signal is presented over the entire area of the display area 1 a having the 720 scanning lines.

FIG. 7 is a timing chart showing an exemplary operation of the liquid-crystal device. In this example, the transfer direction control signal DIRY remains at an L level.

When the liquid-crystal device is supplied with the input video signal Vin, the video line count detector circuit 210 detects the video line count of the input video signal Vin, thereby generating the detected signal Hn. In response to the detected signal Hn, the signal processing circuit 220 generates the start pulse DY, the clock signal CLY, the inverted clock signal CLY', the start pulse DX, the first enable signal ENBY1, and the second enable signal ENBY2, as shown in FIG. 7.

Furthermore, in response to the detected signal Hn, the signal processing circuit 220 performs 3H period polarity inversion, thereby generating a video signal Vs as shown in FIG. 7. The 3H period polarity inversion is a polarity inversion pattern with three lines combined in polarity inversion, for instance, a second line is at a negative polarity, followed by third and fourth lines at a positive polarity (with zero and first lines at a positive polarity).

The reason why the 3H period polarity inversion is performed is as follows. In this example, particular video lines every three lines, for instance, a third line, a sixth line, . . . 3n-th line (n is a natural number), are decimated. For two lines only out of every three lines, the video signal is actually written to the liquid-crystal display panel 100 through the scanning lines 31. The video signal for the two lines to be written is subjected to the stretching process, as will be discussed later. To alternate, with a period shortest possible, the polarity of the video signal to be actually written to the liquid-crystal display panel 100, alternating the polarity of the two-line video signal to be written is required.

The particular video line to be decimated and the line immediately subsequent to the particular video line are set to be of the same polarity, and the line immediately prior to the particular video line is set to be of the opposite polarity. If the particular video line (the 3n-th line) is set to be positive in polarity, the (3n−1)-th line is set to be negative in polarity, the 3n-th line is set to be positive in polarity, and the (3n+1)-th line is set to be positive in polarity. The 3H period polarity inversion is thus performed.

In this example, the video signal that alternates in polarity every two lines is written in the actual liquid-crystal display panel 100. For instance, a positive video signal is written on a first line and a second line, and a negative video signal is written on a third line and a fourth line.

The period of the polarity inversion is 3H because one line out of every three lines is decimated in this example. The polarity of the video signal needs to be controlled on a line-by-line basis in accordance with video lines (the particular video lines) to be decimated so that the number of scanning lines 31 (two lines in this case) supplied with the positive video signal may be equal to the number of scanning lines 31 (two lines in this case) supplied with the negative video signal.

The decimation of lines is performed by concurrently driving, to an H (inactive) level, the first enable signal ENBY1 and the second enable signal ENBY2 at a line to be decimated. Referring to FIG. 7, the first enable signal ENBY1 and the second enable signal ENBY2 are driven to an H (inactive) level at the 3n-th lines. At the 3n-th lines, the scanning signals Y1, Y2, . . . are all driven to an L level, permitting no video signal at all to be written on the pixels. As a result, the 3n-th lines are decimated, and the video signal having the 540 lines per field is equivalently converted to the video signal having the 360 lines per field.

As shown in FIG. 7, the reason why the start pulse DX for use in the data line driving circuit 101 is not fed in the lines to be decimated (i.e., fixed to an L level) is that the sampling of and feeding of the video signal to the data lines 35 are not required at the corresponding lines. The operation of the data line driving circuit 101 is thus suspended to reduce power consumption. The suspension of the start pulse DX is not a requirement during the line decimation.

The driving operation of the two scanning lines 31 is performed by concurrently driving, to an L (active) level, the first enable signal ENBY1 and the second enable signal ENBY2. As shown in FIG. 7, the first enable signal ENBY1 and the second enable signal ENBY2 are set to an L (active) level at the (3n−2)-th lines and the (3n−1)-th lines not to be decimated. For this reason, every two scanning lines 31, i.e., the scanning lines Y1 and Y2, the scanning lines Y3 and Y4, . . . are successively selected. In pixels connected to the two concurrently driven scanning lines 31, the same video signal is written on the vertically adjacent pixels. As a result, the 360-line video is twice stretched.

The output signals N1out, N2out, . . . of the shift register 142 are successively made active every 2H, as shown in FIG. 5. There may occur an overlap between the 2H duration for which the first enable signal ENBY1 and the second enable signal ENBY2 are active and the 2H duration for which the output signals N1out, N2out are active. In such a case, some scanning lines 31 are selected over consecutive horizontal scanning periods, and the liquid-crystal device fails to present normal images.

The duty factor of the clock CLY is set to 1:2 in this example. When the clock signal CLY and the inverted clock signal CLY' shown in FIG. 7 are fed to the shift register 142, odd-numbered output signals N1out, N3out, . . . are set to an L (active) level for the 2H duration, and even-numbered output signals N2out, N4out, . . . are set to an L (active) level for the H duration. The phase of the start pulse DY is determined so that the first half of the duration for which the odd-numbered output signals N1out, N3out, . . . are active comes at the 3n-th lines to be decimated.

At the lines to be decimated, the first enable signal ENBY1 and the second enable signal ENBY2 are set to be inactive, while the first enable signal ENBY1 and the second enable signal ENBY2 are set to be active on the lines for normal driving. The line decimation is performed while the line stretching is carried out.

The scanning lines are prevented from being concurrently activated except during concurrent driving. Referring to FIG. 8, the first enable signal ENBY1 and the second enable signal ENBY2 are deactivated for a predetermined duration at the switching timing of each line.

In a second exemplary embodiment, the scanning line driving circuit 104 is used to drive two scanning lines 31 at the same time at a ratio of one line out of every three lines. The lines to be stretched remain unchanged from the even field to the odd field. In this way, the 540 lines are stretched by 4/3 times, and the input video signal Vin is thus presented on the liquid-crystal display panel 100 having the 720 scanning lines 31.

FIG. 9 is a timing chart showing an exemplary operation of the liquid-crystal device in this case. In this example, the transfer direction control signal DIRY remains at an L level. FIG. 9 shows the operation for the even field. The lines to be stretched remain unchanged between the even field and the odd field, and the operation of the liquid-crystal device A in the odd field is identical to that in the even field.

When the liquid-crystal device A receives the input video signal Vin, the video line count detector circuit 210 detects the video line count of the input video field Vin, thereby generating a detected signal Hn. In response to the detected signal Hn, the signal processing circuit 220 generates the start pulse DY, the clock signal CLY, the inverted clock signal CLY', the start pulse DX, the first enable signal ENBY1, and the second enable signal ENBY2, as shown in FIG. 9.

Furthermore, in response to the detected signal Hn, the signal processing circuit 220 performs 3H period polarity inversion, thereby generating a video signal Vs, as shown in FIG. 9. The 3H period polarity inversion is a polarity inversion pattern with three lines combined in polarity inversion, for instance, a first line is at a positive polarity, followed by a second line at a positive polarity and a third line at a negative polarity.

In this example, particular video lines every three video lines, for instance, a third line, a sixth line, . . . 3n-th line (n is a natural number), are stretched. The video signal with the polarity thereof alternating every two lines is actually written to the liquid-crystal display panel 100. Specifically, the positive video signal is written to the first line, the positive video signal is written to the second line, the negative video signal is written to the third line, the negative video signal is written to the fourth line, and so on.

The polarity of the video signal needs to be controlled on a line-by-line basis in accordance with video lines (the particular video lines) to be stretched so that the number of scanning lines 31 (two lines in this case) supplied with the positive video signal may be equal to the number of scanning lines 31 (two lines in this case) supplied with the negative video signal.

The shift register 142 successively transfers the start pulse DY in response to the clock signal CLY and the inverted clock signal CLY', and gives the output signals U1out, U2out, . . . from the unit circuits U1, U2, . . . , as shown in FIG. 9. The NAND gates N1, N2, . . . NAND gate the output signals U1out, U2out, . . . of adjacent unit circuits, giving the output signals N1out, N2out, . . . , as shown in FIG. 9.

As shown in FIG. 9, the first enable signal ENBY1 and the second enable signal ENBY2 are driven to an L (active) level at the 3n-th line, the first enable signal ENBY1 only remains at an L level at the (3n−2)-th line, and the second enable signal ENBY2 remains at an L level at the (3n−1)-th line.

At the 3n-th line, the scanning signal Y3, Y4, scanning signal Y7 and Y8, are driven to an H (active) level, and two scanning lines 31 are thus selected. At the (3n−n)-th line and the (3n−1)-th line, the scanning signals Y1, Y2 . . . are driven to an H (active) level, and single lines scanning lines 31 are thus selected.

Specifically, on video lines for which two scanning lines 31 are concurrently driven, the first enable signal ENBY1 and the second enable signal ENBY2 are activated, and on the other video lines, one of the first enable signal ENBY1 and the second enable signal ENBY2 is activated. The stretching process is thus performed in accordance with the ratio of lines concurrently driven. Since the concurrent driving is performed for every three lines in this example, the 540 line video signal is stretched by 4/3 times. As a result, the video signal having the 540 lines per field is presented on the liquid-crystal display panel 100 having the 720 scanning lines 31.

The scanning lines are prevented from being concurrently activated except during concurrent driving. Referring to FIG. 10, the first enable signal ENBY1 and the second enable signal ENBY2 are deactivated for a predetermined duration at the switching timing of each line.

In the above-discussed second exemplary embodiment, the lines to be stretched remain unchanged between the even field and the odd field. The lines to be stretched appear as vertically adjacent lines in the liquid-crystal display panel 100, and definition of the display is thus degraded on the lines. The lines suffering from definition degradation occurs periodically on the display screen of the liquid-crystal display panel 100, and if definition degradation takes place on the same lines in both the even field and the odd field, an unnaturally looking image results. In a third exemplary embodiment, the stretching process is performed on one line every three lines, while the lines to be stretched is varied from one field to the next field.

In the even field, the 3n-th line is stretched in the same way as in the second exemplary embodiment discussed with reference to FIG. 9.

In the odd field, the (3n−2)-th line is subjected to the stretching process. FIG. 11 is a timing diagram showing an exemplary operation of the liquid-crystal device. As shown, the first enable signal ENBY1 and the second enable signal ENBY2 are at an L (active) level at the (3n−2)-th line, the first enable signal ENBY1 is driven to an L level at the (3n−1)-th line, and the second enable signal ENBY2 is driven to an L level at the 3n-th line.

In the odd field, two scanning lines 31 are concurrently selected at the (3n−2)-th line with the scanning lines Y1 and Y2, scanning lines Y5 and Y6, . . . driven to an H (active) level. In contrast, in the even field, the scanning signals Y3 and Y4, scanning signals Y7 and Y8 . . . are driven to an H (active) level.

By differentiating the lines to be stretched from the even field to the odd field, the scanning lines 31 concurrently driven are made different between the even field and the odd field. As a result, lines suffering from definition degradation are not fixed onto particular video lines, and the definition of the entire screen is made uniform.

In this exemplary embodiment as well, the scanning lines are prevented from being concurrently activated except during concurrent driving. Referring to FIG. 10, in the even field, the first enable signal ENBY1 and the second enable signal ENBY2 are deactivated for a predetermined duration at the switching timing of each line, and referring to FIG. 12, in the odd field, the first enable signal ENBY1 and the second enable signal ENBY2 are deactivated for a predetermined duration at the switching timing of each line.

In the preceding exemplary embodiments, the decimation process is performed in combination with the stretching process in the first embodiment. The present invention is not limited to this, and the decimation process only may be performed.

In the preceding exemplary embodiments, the scanning lines in the effective display area are handled to perform the normal driving, the decimation process, and the stretching process. The device thus presents the input video signal having the video line count different from the scanning line count thereof. The present invention may perform the normal driving, the decimation process, and the stretching process not only to the scanning lines in the effective display area but also to all scanning lines including dummy scanning lines outside the effective display area.

In the preceding exemplary embodiments, the TFT array substrate 10 may be fabricated of a transparent insulating substrate, such as a glass substrate, and the switching elements (TFTs 30) and elements of a driving circuit of the pixel assembly are produced on the substrate. The present invention is not limited to this. For instance, the TFT array substrate 10 may be fabricated of a semiconductor substrate, and an insulated-gate field-effect transistor is arranged with the source, drain, and channel thereof formed on the surface of the semiconductor substrate, thereby forming the switching elements and the elements of a driving circuit of the pixels. When the TFT array substrate 10 is fabricated of the semiconductor substrate, the TFT array substrate 10 is used as a reflective type with the pixel electrodes 11 formed of aluminum, rather than being used as a transmissive type. The TFT array substrate 10 may be fabricated of a transparent substrate, with the pixel electrodes 11 employed as a reflective type.

In the preceding exemplary embodiments, the switching element of the pixel assembly is constructed of a three-terminal device such as a TFT. Alternatively, the switching element may be constructed of a two-terminal device such as a diode. When a two-terminal device is used for the switching element of the pixel, the scanning lines 31 are produced on one substrate, the data lines 35 are produced on the other substrate, and the two-terminal device needs to be arranged between one of the scanning lines 31 and the data lines 35 and the pixel electrode 11.

In the preceding exemplary embodiments, the liquid-crystal device using a liquid crystal as an electro-optical material is discussed. The present invention is not limited to this. Besides the liquid crystal, the present invention may be applied to a device that employs an electroluminescence device as an electro-optical material. The present invention may be applied to the above-discussed liquid-crystal device and the electro-optical device having a construction similar thereto.

Discussed next is a liquid-crystal projector as one example of electronic equipment incorporating the liquid-crystal device of each of the above exemplary embodiments. FIG. 13 is a plan view showing the construction of the liquid-crystal projector. The liquid-crystal projector 1100 includes three liquid-crystal modules, each including the liquid-crystal device as the electro-optical device, as light valves 100R, 100G, and 100B for R (red), G (green), and B (blue).

As shown in FIG. 13, in the liquid-crystal projector 1100, a light beam emitted from a lamp unit 1102 of a white light source, such as a metal halide lamp, is separated into the three RGB primary colors, R light, G light, and B light through three mirrors 1106, and two dichroic mirrors 1108. The three color light beams are guided to respective light valves 100R, 100G, and 100B. To avoid light loss in a long light path, the B light beam is guided through a relay lens system 1121 composed of an entrance lens 1122, a relay lens 1123, and an exit lens 1124. Light components of the three primary colors light-modulated through the light valves 100R, 100G, and 100B are synthesized through a dichroic prism 1112, and projected onto a screen 1120 as a color image through a projection lens 1114.

The light valves 100R, 100G, and 100B need no color filter because the dichroic mirrors 1108 guide light beams of the R, G, B primary colors respectively thereto.

Besides the liquid-crystal projector, the electronic equipment may be a liquid-crystal television, a view-finder type or direct monitoring type video cassette recorder, a car navigation system, a pager, an electronic pocketbook, a table-top calculator, a word processor, a workstation, a video telephone, a POS terminal, or an apparatuses with a touch panel. The electro-optical device of the present invention may be applied to these pieces of electronic equipment.

A variety of modifications is possible without departing from the scope of the present invention.

What is claimed is:

1. An electro-optical device, comprising:

a plurality of data lines;

a plurality of scanning lines;

a data line driver circuit that drives the plurality of data lines;

a scanning line driver circuit that drives the plurality of scanning lines;

a video line count detector circuit that detects a horizontal video line count of an input video signal per at least one of one field and one frame;

a signal processing circuit that decodes the input video signal into component video signals, including decimation or stretching of one or more of horizontal video lines of data corresponding to RGB colors based on the horizontal video line count detected by the video line count detector circuit, in three horizontal scanning periods of polarity inversion; and a serial-to-parallel converter circuit that converts the component video signals to parallel signals.

2. The electro-optical device according to claim 1, further comprising a plurality of video signal lines, to which the parallel signals are output.

3. The electro-optical device according to claim 2, the number of the plurality of video signal lines being a multiple of three.

4. The electro-optical device according to claim 1, an output of the parallel signals to corresponding data lines of the plurality of data lines being controlled by sampling signals output from the data line driver circuit.

5. The electro-optical device according to claim 1, a plurality of switching elements being disposed correspondingly to intersections of the plurality of data lines and the plurality of scanning lines, each of the plurality of switching elements being connected to a pixel electrode.

6. The electro-optical device according to claim 5, further comprising a liquid crystal layer, to which voltage is supplied via the pixel electrode.

7. The electro-optical device according to claim 1, the scanning line driver circuit enabling outputting of scanning signals to at least two scanning lines of the plurality of scanning lines.

8. The electro-optical device according to claim 7, the at least two scanning lines being adjacent.

9. A method of operating an electro-optical device that includes a plurality of data lines, a plurality of scanning lines, a data line driver circuit that drives the plurality of data lines, and a scanning line driver circuit that drives the plurality of scanning lines, the method comprising:

detecting horizontal video lines of an input video signal per at least one of one field and one frame;

decoding the input video signal into component video signals, including decimation or stretching of one or more of horizontal video lines of data corresponding to RGB colors based on horizontal video line count of an input video signal; in three horizontal scanning periods of polarity inversion; and converting the component video signals to parallel signals.

10. The method according to claim 9, further comprising controlling output of the parallel signals to corresponding data lines of the plurality of data lines by sampling signals that are output from the data line driver circuit.

11. An electronic equipment, comprising:

the electro-optical device according to claims.

12. An electro-optical device, comprising:

a plurality of data lines;

a plurality of scanning lines;

a data line driver circuit that drives the plurality of data lines;

a scanning line driver circuit that drives the plurality of scanning lines;

a video line count detector circuit that detects a horizontal video line count of an input video signal per at least one of one field and one frame;

a signal processing circuit that decodes the input video signal into component video signals with alternating polarity every two scanning lines, including decimation or stretching of horizontal video lines based on the horizontal video line count detected by the video line count detector circuit; and a serial-to-parallel converter circuit that converts the component video signals to parallel signals.

13. The electro-optical device according to claim 12, further comprising a plurality of video signal lines, to which the parallel signals are output.

14. The electro-optical device according to claim 13, the number of the plurality of video signal lines being a multiple of three.

15. The electro-optical device according to claim 12, an output of the parallel signals to corresponding data lines of the plurality of data lines being controlled by sampling signals output from the data line driver circuit.

16. The electro-optical device according to claim 12, a plurality of switching elements being disposed correspondingly to intersections of the plurality of data lines and the plurality of scanning lines, each of the plurality of switching elements being connected to a pixel electrode.

17. The electro-optical device according to claim 16, further comprising a liquid crystal layer, to which voltage is supplied via the pixel electrode.

18. The electro-optical device according to claim 12, the scanning line driver circuit enabling outputting of scanning signals to at least two scanning lines of the plurality of scanning lines.

19. The electro-optical device according to claim 18, the at least two scanning lines being adjacent.

20. A method of operating an electro-optical device that includes a plurality of data lines, a plurality of scanning lines, a data line driver circuit that drives the plurality of data lines, and a scanning line driver circuit that drives the plurality of scanning lines, the method comprising:

detecting horizontal video lines of an input video signal per at least one of one field and one frame;

decoding the input video signal into component video signals with alternating polarity every two scanning lines, including decimation or stretching of horizontal video lines based on horizontal video line count of an input video signal; and converting the component video signals to parallel signals.

21. The method according to claim 20, further comprising controlling output of the parallel signals to corresponding data lines of the plurality of data lines by sampling signals that are output from the data line driver circuit.

22. An electronic equipment, comprising:

the electro-optical device according to claim 12.

* * * * *